US006923410B2

(12) United States Patent
Chang

(10) Patent No.: US 6,923,410 B2
(45) Date of Patent: Aug. 2, 2005

(54) CONTRACTIBLE TABLE LEG STRUCTURE

(76) Inventor: Chien-Kuo Chang, P.O. Box 36-80, Taichung City (TW)

( * ) Notice: Subject to any disclaimer, the term of this patent is extended or adjusted under 35 U.S.C. 154(b) by 0 days.

(21) Appl. No.: 10/645,098

(22) Filed: Aug. 21, 2003

(65) Prior Publication Data

US 2005/0040300 A1 Feb. 24, 2005

(51) Int. Cl.[7] ..... F16M 11/26

(52) U.S. Cl. ..... 248/188.5; 248/188.3; 248/188.1; 248/161; 248/413; 248/157; 108/147.19; 108/147.2

(58) Field of Search ..... 248/405, 413, 248/406.2, 125.8, 599, 600, 601, 188.1, 188.2, 188.3, 188.5, 132, 161, 404, 157, 295.11, 298.1; 297/344.18, 411.36; 108/147.2, 147.21, 147, 146, 147.19

(56) References Cited

U.S. PATENT DOCUMENTS 633,833 A * 9/1899 Goshorn ..... 108/146
1,687,128 A * 10/1928 Cadwalader ..... 108/63
2,792,268 A * 5/1957 Stanley ..... 108/136
2,963,253 A * 12/1960 Maier et al. ..... 248/298.1
3,006,706 A * 10/1961 Park et al. ..... 108/116
3,058,715 A * 10/1962 Porkka ..... 108/146
3,191,902 A * 6/1965 Goller ..... 248/188.5
3,479,973 A * 11/1969 Bartlett et al. ..... 108/141
4,080,080 A * 3/1978 Cisler ..... 403/108
5,020,752 A * 6/1991 Rizzi et al. ..... 248/162.1
5,352,057 A * 10/1994 Zody ..... 403/109.3

* cited by examiner

*Primary Examiner*—Kimberly Wood
(74) *Attorney, Agent, or Firm*—Charles E. Baxley

(57) ABSTRACT

The present invention discloses a contractible table leg structure, comprising: an external sleeve; a folding rod, being a rod member with a cross section substantially in successive V-shaped turning surfaces, and having an included angle in the middle, a plurality of folding surfaces to define a plurality of interface corners, and the folding rod passing through the interior of the external sleeve; a bolt member, being secured on the external sleeve, and its inner end corresponding to the included angle of the folding rod; and when bold the bolt member being tightly secured, so that the folding rod produces a deformation stress to press the interface corner against the inner wall of the external sleeve and fix the position of the folding rod.

10 Claims, 5 Drawing Sheets

CONTRACTIBLE TABLE LEG STRUCTURE

BACKGROUND OF THE INVENTION

1. Field of the Invention

The present invention relates to a table leg, more particularly to a contractible table leg capable of adjusting the height of a table to different levels.

2. Description of the Related Art

In general, a traditional contractible table leg structure as shown in FIG. 1 generally includes an external sleeve and an internal sleeve, and the leg coupled to the end of the external sleeve securely standing on the floor, and the internal sleeve precisely passing through the interior of the external sleeve with the top end connecting with the tabletop (not shown in the figure). The internal sleeve can axially move inside the external sleeve to adjust the height of the tabletop. An adjustable bolt is disposed on the external sleeve proximate the top of the external sleeve and tightening the adjustable bolt can press itself against the surface of the internal sleeve to secure the internal sleeve and set the tabletop to a predetermined height. However, the foregoing traditional contractible table leg has the following problems:

The internal sleeve can contract and move inside the external sleeve, but there is a gap between the outer wall of the internal sleeve and the inner wall of the external sleeve (as shown in FIG. 2A). When the adjustable bolt presses on the internal sleeve, only half of the side surface of the internal sleeve is pressed tightly against the inner wall of the external sleeve (as shown in FIG. 2B). Since the internal and external sleeves have smooth surfaces without sufficient friction, there is still a possibility for the internal sleeve to slide downward due to external forces or actions or the weight of any object on the tabletop, and thus not sufficiently providing an effective fixing function. Further, when the internal sleeve and the external sleeve are manufactured, it is necessary to pay more attention on the precision of both internal and external diameters. If a slight error occurs, the internal sleeve may be shaken in the direction as indicated by the arrows in FIG. 2B and affect the stability, even after the adjustable bolt is secured.

SUMMARY OF THE INVENTION

The primary objective of the present invention is to provide a contractible table leg structure to solve the problem of the insufficient stability and positioning of the internal and external sleeves of the contractible table leg as described in the foregoing background. A folding rod with deformation stress of the present invention is used to replace the internal sleeve with substantial oval cross section as described in the foregoing background. When the folding rod is secured by a bolt member, the folding rod will produce a deformation stress, such that the folding rod can be pressed tightly inside the inner wall of the sleeve. The positioning ability in the axial direction and the transversal direction of the folding rod can enhance the prior art.

Another objective of the present invention is to provide a contractible table leg structure, which comprises a folding rod with deformation stress to compensate the discrepancy of the gap from the external sleeve, such that the manufacturing precision will not become a difficulty or a bottleneck of the manufacturing process.

A further objective of the present invention is to provide a contractible table leg structure, which comprises a folding rod with successive V-shaped folding surfaces. The present invention has a manufacturing process much simpler than the prior-art internal sleeve with oval cross section and an enhanced structural strength.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
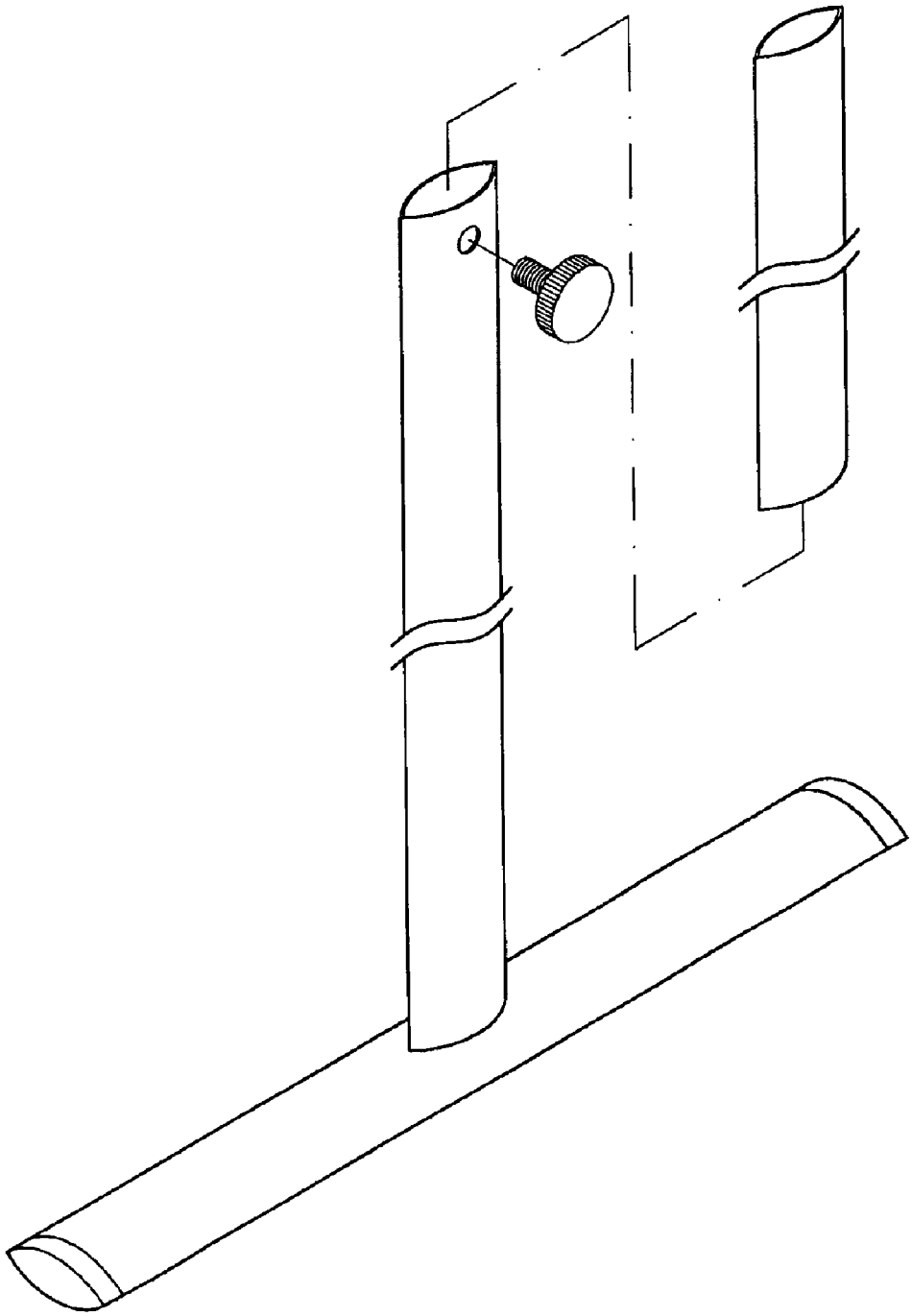
FIG. 1 PRIOR ART
FIG. 1 is a perspective diagram of the disassembled parts of the contractible table leg according to a prior art.
Figure 2A:
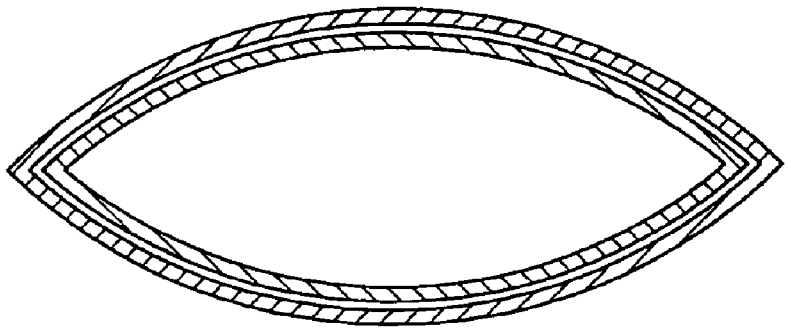
FIG.2A PRIOR ART
FIG. 2A is a cross-sectional diagram of an assembly of a prior-art contractible table leg.
Figure 2B:
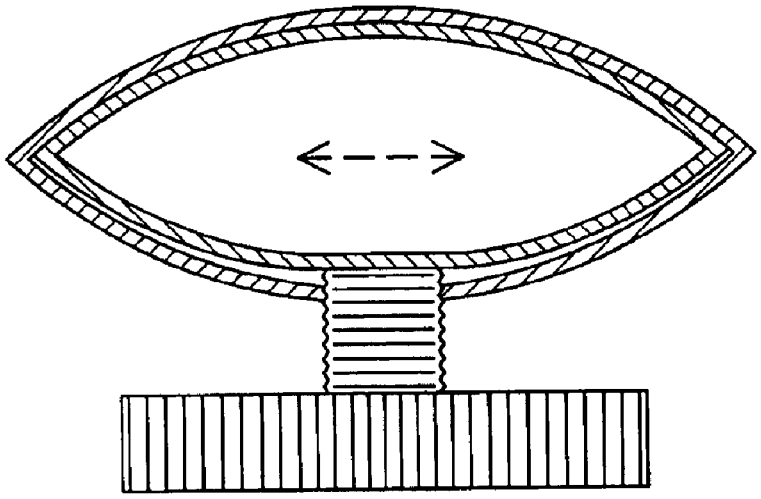
FIG.2B PRIOR ART
FIG. 2B is another cross-sectional diagram of an assembly of a prior-art contractible table leg.
Figure 3:
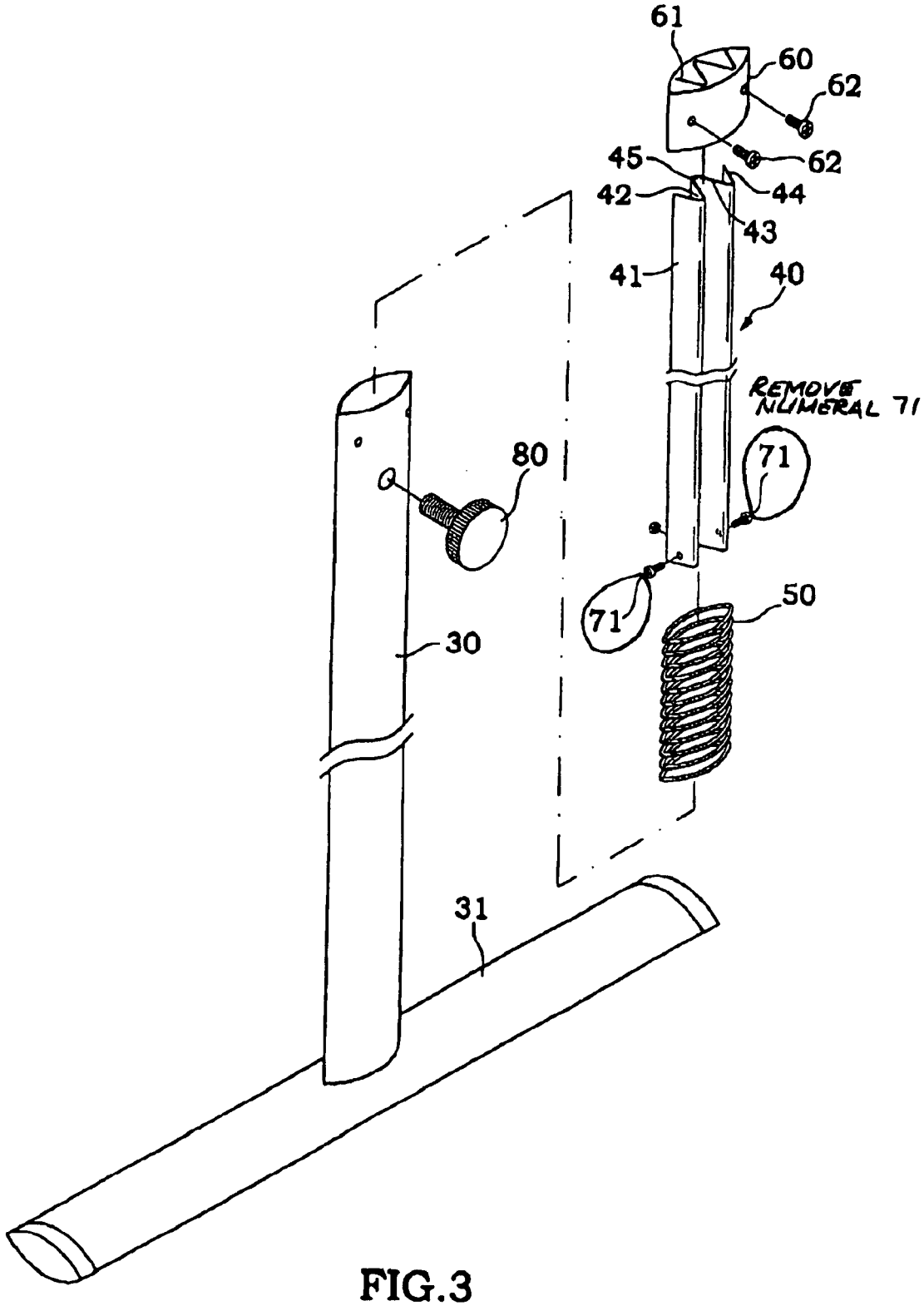
FIG. 3 is a perspective diagram of the disassembled parts of the present invention.
Figure 4:
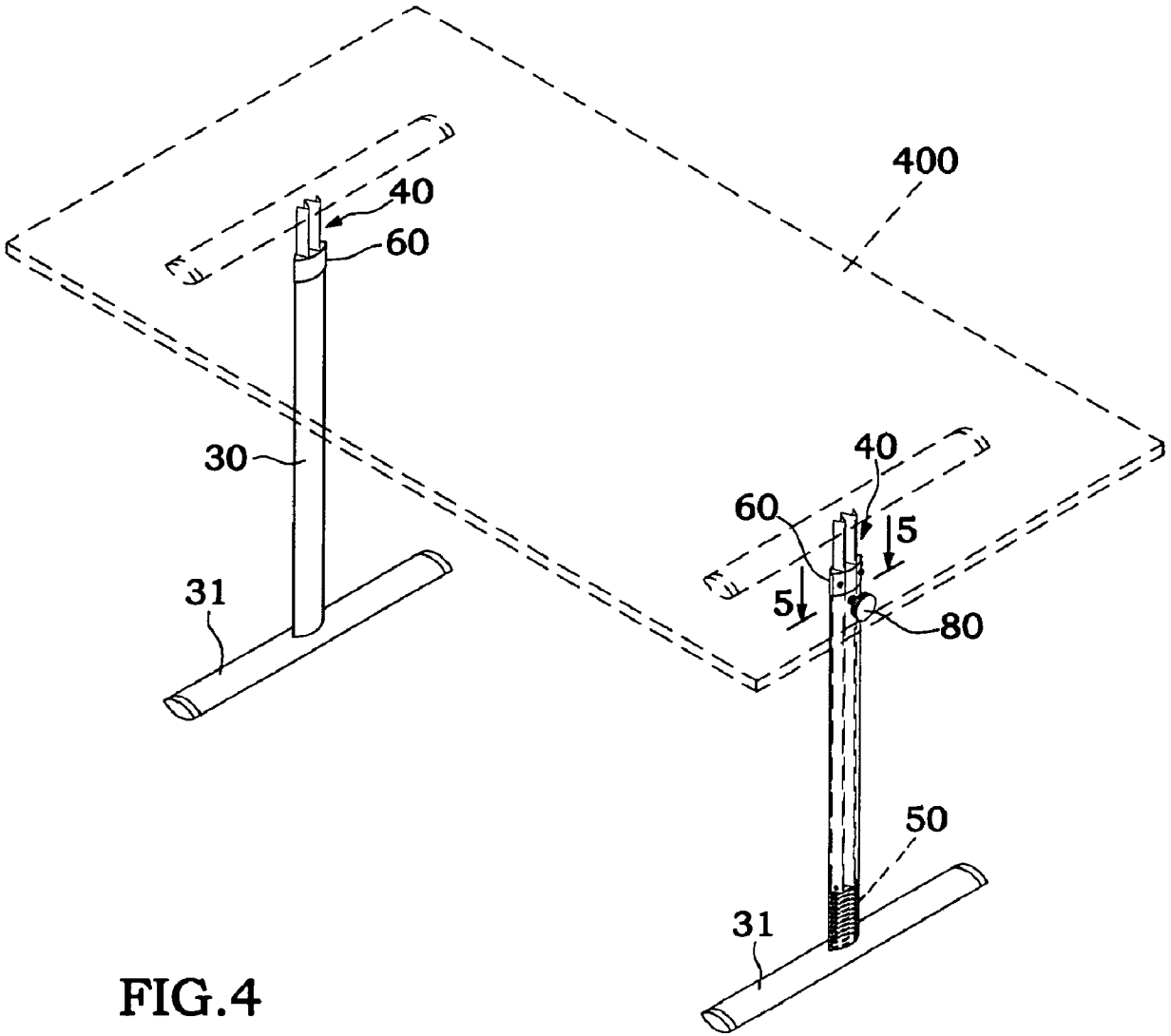
FIG. 4 is a perspective diagram of the assembled structure of the present invention.
Figure 5:
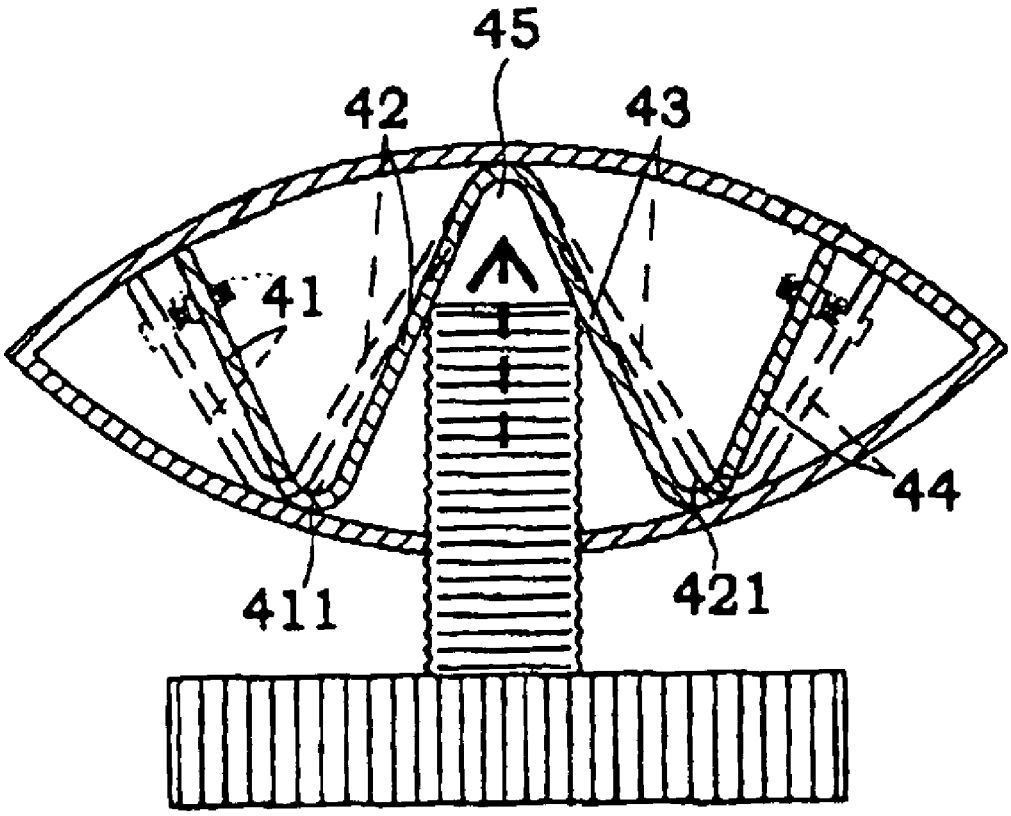
FIG. 5 is a cross-sectional diagram along the direction 5—5 as shown in FIG. 4.

Please refer to FIG. 3 for the contractible table leg structure of the present invention, which comprises:

an external sleeve 30, being a pipe member with an oval cross section, and having a stand 31 coupled to its end for standing firmly on the floor;

a folding rod 40, as shown in FIGS. 3 and 4, being a rod member with a cross-section substantially in successive V-shaped folding surfaces, and this embodiment adopting at least 4 turnings 41, 42, 43, 44, wherein the middle two turnings 42, 43 defining an included angle 45 for the bolt, and the folding rod 40 passing through the external sleeve 30, and its top being coupled to a table top 400;

a spring 50, as shown in FIGS. 3 and 4, being disposed at the bottom inside the external sleeve 30 and supporting the bottom of the folding rod 40;

a positioning decorative sleeve, as shown in FIGS. 3 and 4, being a hollow sleeve with an oval cross section, and sleeved at the top of the external sleeve 30, and the top of the positioning decorative sleeve being closed and having a folding hole 61 with the same shape and size of the cross section of the folding rod 40 for sheathing the folding rod 40; the wall of the positioning decorative sleeve 60 being fixed on to the wall of the external sleeve 30 by a fixing member 62;

a folding rod axis limit structure, for preventing the folding rod 40 from being easily drawn out from the external sleeve 30 and the positioning decorative sleeve 60, primarily having a transversal fixing member 71 disposed at the bottom of the folding rod 40 and the fixing member 71 being used to latch the inner top surface of the positioning decorative sleeve 60 and preventing the folding rod 40 from being drawn out entirely, and the fixing member 71 of this embodiment adopting two screws to secure the bottom of the folding rod 40 in order to constitute the transversal extended structure and block the top inner surface of the positioning decorative sleeve 60;

a bolt member 80, being secured on the external sleeve 30, and a supporting and limiting end inside the bolt corresponding to the included angle 45 of the folding rod 40;

by means of the foregoing elements, when the bolt member 80 is loosened, the folding rod 40 can be moved vertically in the external sleeve 30, and the elasticity of the spring 50 is used to adjust the folding rod 40 with less energy, and when the folding rod 40 is pressed, the spring is compressed to lower the height of the folding rod 40 in order to adjust the tabletop 400 to a predetermined height. The bolt member 80 is secured as shown in FIG. 5, so that the inner supporting end latches the included angle 45 of the folding rod 40, and the inward pressure enlarges the included angle 45. One the included angle 45 is changed, the interface corner 411, 421 of the turnings 41, 42, 43, 44 will be changed accordingly, and the folding rod 40 will produce a deformation stress. Such deformation stress further presses the folding rod 40 against the inner wall of the external sleeve 30 into the folding hole 61 in order to position the folding rod 40.

Compared with the aforementioned traditional contractible table leg, the present invention has the following advantages:

The folding rod 40 of this invention provides a plurality of folding surfaces 41, 42, 43, 44 in contact with the folding hole 61 of the positioning decorative sleeve 60, and a plurality of interface corners 411, 421 for pressing against and limiting the inner wall of the external sleeve 30, and thus increasing the friction between the folding rod 40 and the folding hole 61 with the inner wall of the external sleeve 30. When the bolt member 80 is secured, the folding rod 40 produces a deformation stress, and such deformation stress further presses the folding rod 40 into the folding hole 61, and the interface corner 411, 421 is pressed further onto the inner wall of the external sleeve 30. Therefore, the folding rod 40 of the present invention has a more effective positioning capability than the traditional oval internal sleeve. Even if there is a slight discrepancy in the folding rod 40, the folding hole 61, or the external sleeve 30, the deformation stress can compensate such discrepancy, so that the folding rod 40 can be positioned precisely into the folding hole 61 and the external sleeve 30.

The folding rod 40 of this invention is made of metal material, and the positioning decorative sleeve 60 is made of plastic material. The friction of the plastic material can improve the effective positioning capability of the folding rod 40.

The manufacturing of the folding rod 40 of this invention could be accomplished by the existing prior-art technology, and thus incurring a low manufacturing cost.

Although the structure of the folding rod 40 in accordance with this invention is in a flat rod shape, the folded structure enhances its strength without the risk of bending the structure.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. A contractible table leg structure, comprising:

an external sleeve;

a folding rod being a rod member capable of producing a deformation stress, and passed through the interior of said external sleeve;

a bolt member, transversally secured on said external sleeve, and producing an external force on said folding rod when said bolt member contacts the folding rod when being tightly secured, so that said folding rod produces a deformation stress causing the folding rod to deform and to press against and position into said external sleeve.

2. The contractible table leg structure of claim 1, wherein said folding rod comprises a rod member having a cross section with successive V-shaped folding surfaces.

3. The contractible table leg structure of claim 2, wherein said plurality of folding surfaces of the folding rod define a plurality of interface corners and included angles.

4. The contractible table leg structure of claim 3, wherein said bolt member produces and external force, acting on the included angle of said folding rod such that said folding rod produces a deformation stress.

5. The contractible table leg structure of claim 2, wherein said folding rod comprises at least four folding surfaces with a cross section substantially including successive V-shaped turnings.

6. A contractible table leg structure, comprising:

an external sleeve;

a folding rod, comprising a rod member capable of producing a deformation stress, and passed through the interior of said external sleeve with said folding rod having a bottom;

a bolt member, transversally secured on said external sleeve, and producing an external force on said folding rod when said bolt member being tightly secured, so that said folding rod produces a deformation stress to urge said folding rod to press against said external sleeve wherein said external sleeve has a top end and an inner bottom and at its inner bottom comprises a spring that presses and supports the bottom of said folding rod.

7. A contractible table leg structure, comprising:

an external sleeve;

a folding rod, comprising a rod member capable of producing a deformation stress, and passed through the interior of said external sleeve;

a bolt member, transversally secured on said external sleeve, and producing an external force on said folding rod when said bolt member being tightly secured, so that said folding rod produces deformation stress to urge said folding rod to press against said external sleeve further comprising a positioning decorative sleeve disposed onto the top end of said external sleeve wherein said positioning decorative sleeve has a closed top surface and with said top surface comprising a folded hole having substantially the same shape and size of the cross section of said folding rod and with said folding rod projecting through said folded hole.

8. The contractible table leg structure of claim 7, wherein said folding rod at its bottom comprises a folding rod axis limit structure for preventing the folding rod axis from moving upward and being separated from the external sleeve and said positioning decorative sleeve.

9. The contractible table leg structure of claim 8, wherein said folding rod axis limit structure comprises at least one transversal fixing member disposed at the bottom of said folding rod.

10. The contractible table leg structure of claim 9, wherein said transversally fixing member comprises a screw member each being transversally secured on both sides of the bottom of said folding rod.

* * * * *